US011920312B1

(12) United States Patent
Breton

(10) Patent No.: US 11,920,312 B1
(45) Date of Patent: Mar. 5, 2024

(54) DOCKING GUIDE FOR BOAT

(71) Applicant: GESTION LOGISCASA INC., Quebec (CA)

(72) Inventor: Daniel Breton, Quebec (CA)

(73) Assignee: GESTION LOGISCASA INC., Quebec (CA)

( * ) Notice: Subject to any disclaimer, the term of this patent is extended or adjusted under 35 U.S.C. 154(b) by 12 days.

(21) Appl. No.: 17/886,295

(22) Filed: Aug. 11, 2022

(51) Int. Cl.
*E02B 3/26* (2006.01)

(52) U.S. Cl.
CPC ..... *E02B 3/26* (2013.01)

(58) Field of Classification Search
CPC ..... E02B 3/26
See application file for complete search history.

(56) References Cited

U.S. PATENT DOCUMENTS

| | | | | |
|---|---|---|---|---|
| 3,031,093 A | | 4/1962 | Holsclaw | |
| 3,187,706 A | | 6/1965 | Ross | |
| 3,783,816 A | | 1/1974 | de Chassy et al. | |
| 4,284,026 A | * | 8/1981 | Martinson | E02B 3/26 114/230.15 |
| 5,911,189 A | | 6/1999 | Ryan | |
| 6,995,662 B2 | | 2/2006 | Wortsmith | |
| 8,056,491 B2 | | 11/2011 | Wright et al. | |
| 2002/0152944 A1 | * | 10/2002 | Ryan | B63B 21/00 114/230.1 |
| 2023/0220642 A1 | * | 7/2023 | Farrell | E02B 3/26 405/212 |

FOREIGN PATENT DOCUMENTS

| | | | | |
|---|---|---|---|---|
| EP | 2071083 B1 | | 2/2012 | |
| GB | 2073119 A | * | 10/1981 | B63B 21/00 |

* cited by examiner

*Primary Examiner* — Janine M Kreck
(74) *Attorney, Agent, or Firm* — Agence de Brevets Fournier

(57) ABSTRACT

A docking guide for a boat includes a platform having front and back sides, a first lateral side for mounting to a dock, and a second lateral side opposite the first lateral side. The platform has an opening, located between the first and second lateral sides, for receiving a front of the boat therein. The docking guide further includes at least one anchoring element secured to the platform on the second lateral side, a first deflector mounted to the platform thereabove to be partially in the opening near an intersection of the front and second lateral sides; and a second deflector mounted to the platform thereabove to be partially in the opening near an intersection of the front and first lateral sides. The second deflector is shifted towards the back side relatively to the first deflector so that, when the boat moves within the opening, it is forced in a parallel relationship with the dock by its contact with the first and second deflectors.

27 Claims, 12 Drawing Sheets

DOCKING GUIDE FOR BOAT

FIELD

The present disclosure relates to pleasure boats and more specifically to a docking guide for pleasure boats or the likes.

BACKGROUND

Docking a boat, while a common operation, requires a mixed of science and art, wherein experience plays a large role in limiting damages to the boat during the operation, especially when there is wind, and the water plan is agitated and/or when space is limited.

Devices and systems have been designed to help docking a boat parallel to a dock, such as the device described in U.S. Pat. No. 3,187,706, issued to Ross on Jun. 8, 1965, and titled "Boat Fending, Mooring and Docking Apparatus". Ross device includes a system of cable and spring which aims at gradually slowing down the boat while forcing a parallel relationship to the dock.

A first drawback of such a device by Ross is that the boat must approach the dock very slowly for the device to operate correctly. Also, the angle and position of approach is critical in the docking success.

SUMMARY

According to an illustrative embodiment, there is provided a docking guide for a boat comprising:

- a platform having front and back sides, a first lateral side for mounting to a dock, and a second lateral side opposite the first lateral side; the platform having an opening, for receiving a front of the boat therein, located between the first and second lateral sides;
- at least one anchoring element secured to the platform on the second lateral side;
- a first deflector mounted to the platform thereabove so as to be partially in the opening near an intersection of the front and second lateral sides; and
- a second deflector mounted to the platform thereabove so as to be partially in the opening near an intersection of the front and first lateral sides; the second deflector being shifted towards the back side relatively to the first deflector;
- whereby, the boat moving towards and then within the opening of the platform is forced in a parallel relationship with the dock by its contact with the first and second deflectors.

According to another illustrative embodiment, there is provided a docking guide for a boat having a bow, the docking guide comprising:

- a dead-end channel defining a longitudinal axis and two lateral sides, having an entrance between the two lateral sides, and being configured and sized for receiving at least the bow of the boat therein through the entrance, and
- two deflectors, each positioned at the entrance on a respective lateral side thereof; the two deflectors being shifted longitudinally Other objects, advantages and features of the docking guide for a boat will become more apparent upon reading the following non-restrictive description of preferred embodiments thereof, given by way of example only with reference to the accompanying drawings.

DETAILED DESCRIPTION

Figure 1:
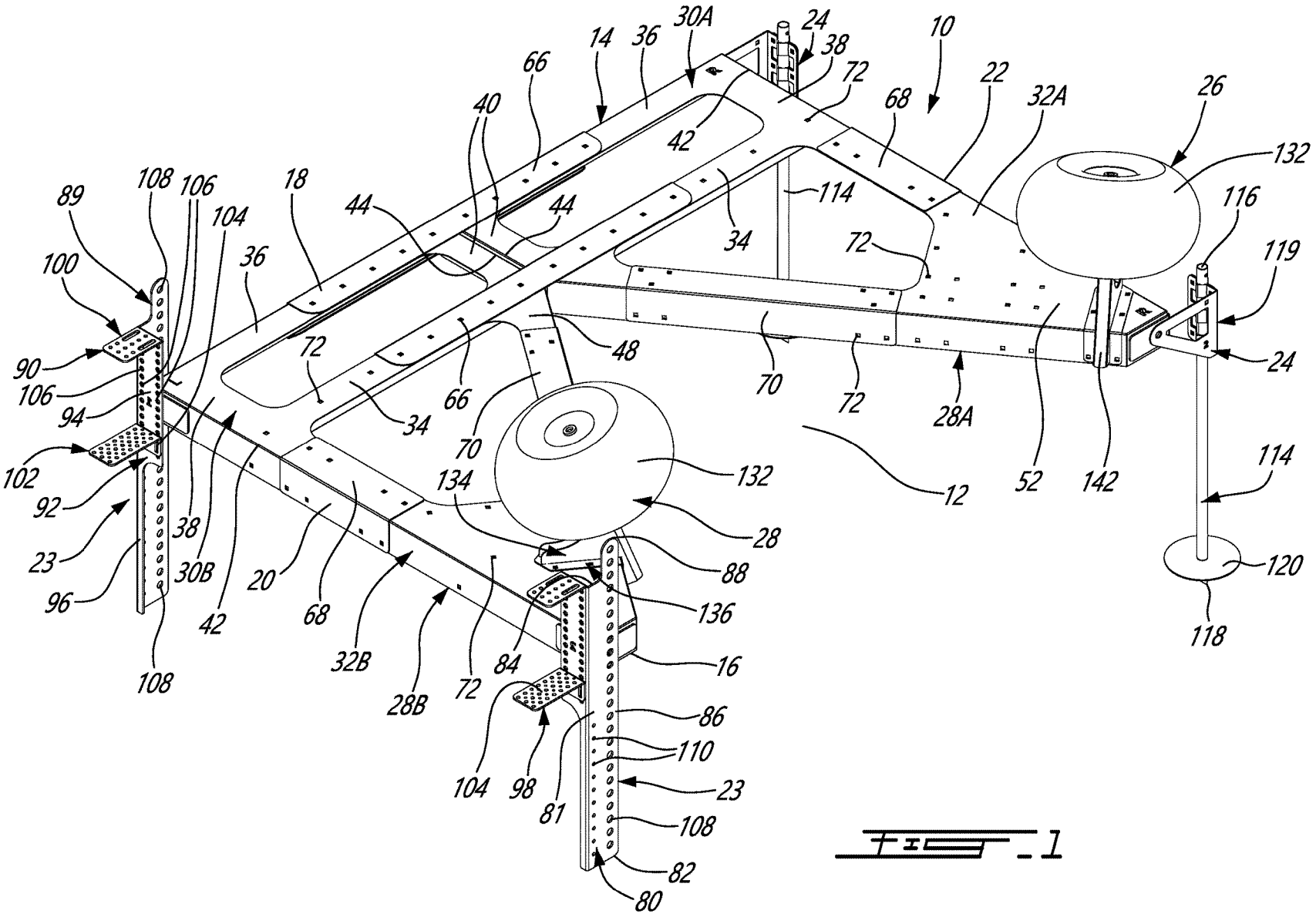
FIG. 1 is a perspective view of a docking guide for boat according to a first illustrative embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

A docking guide 10 according to a first illustrative embodiment will be described with reference first to FIGS. 1 to 3.

Figure 2:
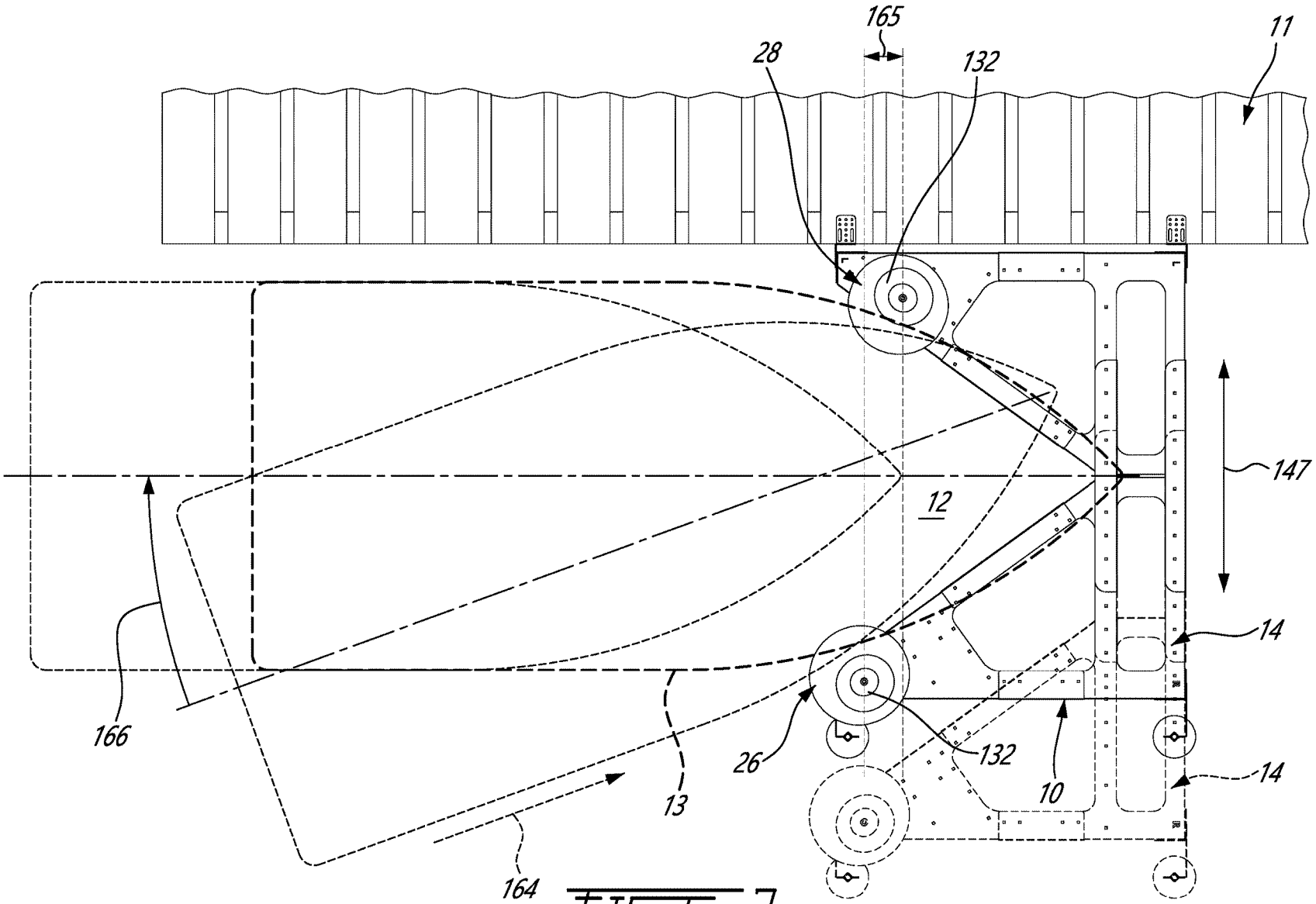
FIG. 2 is a top plan view of the docking guide from FIG. 1, shown mounted to a dock and illustrating its guiding of a boat.
Figure 3:
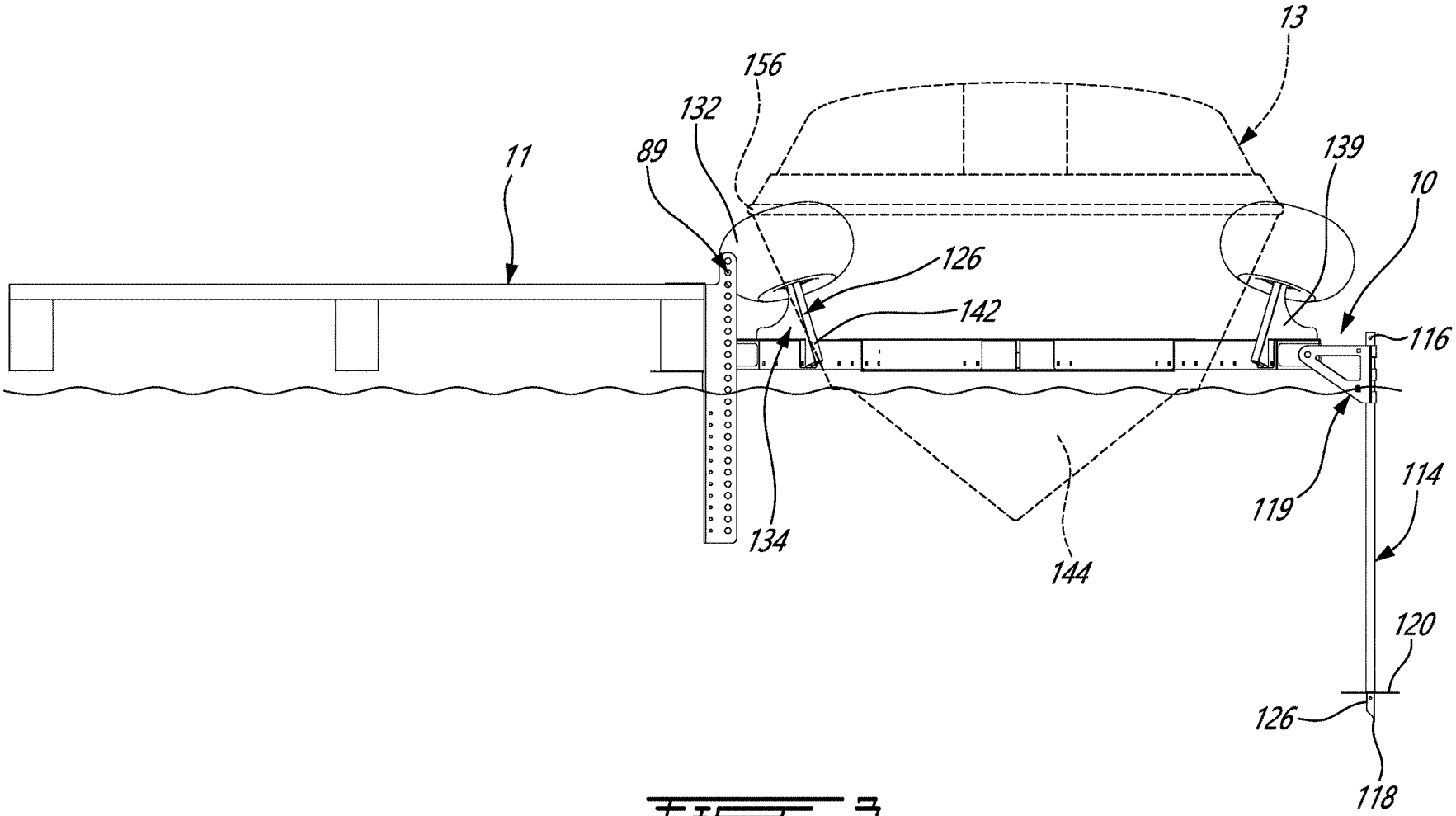
FIG. 3 is a back elevation of the docking guide from FIG. 1, shown mounted to a dock and illustrating a boat therein.

As can be seen in FIGS. 2 and 3, the docking guide 10 can be secured to a dock 11 and is configured to automatically force a boat 13 moving towards and within an opening 12 of the guide 10 in a parallel relationship with the dock 11.

Also, as will be described hereinbelow in more detail, the docking guide 10 is adaptable for different configurations and sizes of boats and is also demountable so as to be transportable in a compact manner, for example for shipping or storing purposes.

The docking guide 10 comprises a rigid platform 14 having front and back sides 16 and 18, a first lateral side 20 for mounting to the dock 11, and a second lateral side 22 opposite the first lateral side 20, dock mounting brackets 23 for securing the platform 14 to the dock 11 via at its first lateral side 20, two anchoring elements 24 secured to the rigid platform 14 on the second lateral side 22, a first shock-absorbing deflector 26 mounted to the platform 14 thereabove so as to be partially in the opening 12 near an intersection of the front and second lateral sides 14 and 22, and a second shock-absorbing deflector 28 mounted to the platform 14 thereabove so as to be partially in the opening 12 near an intersection of the front and first lateral sides 14 and 20.

The rigid platform 14 according to the illustrative embodiment is assembled from a plurality of pieces so as to allow 1) shipping and storing thereof in relatively compact boxes as will be described hereinbelow in more detail, and 2) a plurality of configurations, each better adapted to a range of boat sizes and configurations, also as will be described hereinbelow in more detail.

More specifically, with reference also to FIGS. 6A-7B, the platform 14 is made of two (2) symmetrical lateral sides 28A, 28B, each formed by a generally rectangular frame element 30A, 30B and a generally triangular frame element 32A, 32B.

Each of the generally rectangular frame elements 30A and 30B are defined by parallel front and back portions 34 and 36 and two lateral side portions 38 and 40 extending therebetween near respective longitudinal ends 42 and 44 thereof.

Each frame elements 30A and 30B further includes first connecting part 46, in the form of a first straight portion that extends linearly from the lateral side portion 38, and a second connecting part 48, in the form of a second straight portion that extends from the lateral side portion 40, so as to define an acute angle therewith.

All exterior side of the frame elements 30A and 30B, with the exceptions of the front portion thereof, are provided with a peripheral flange 50, that extends from the respective portion perpendicularly therefrom. In addition to adding rigidity to the platform 14, the flange 50 further provides an additional surface for assembling parts of the docking guide 10.

Each of the generally triangular frame elements 32A, 32B is in the form a generally triangular shaped plate 52 having a first corner 54 that is truncated, a first connecting part, in the form of a first straight portion 56, extending from a second corner of the triangular-shaped plate 52, and yielding a longer straight side 58 thereof, and a second connecting part, in the form of a second straight portion 60, extending from a third corner, and yielding a shorter straight side 62 of the triangular plate 52.

As will be described hereinbelow in more detail, the first and second straight connecting parts 56 and 60 of the triangular frame elements 32A, 32B are configured and relatively positioned to define linear extensions of the first and second connecting parts 46 and 48 of the rectangular frame elements 30A, 30B respectively when the platform 14 is assembled.

All exterior side of the frame elements 32A and 32B, with the exceptions of the side thereof opposite the truncated corner 54, are provided with a peripheral flange 64, that extends from the respective portion perpendicularly therefrom.

Figure 5A:
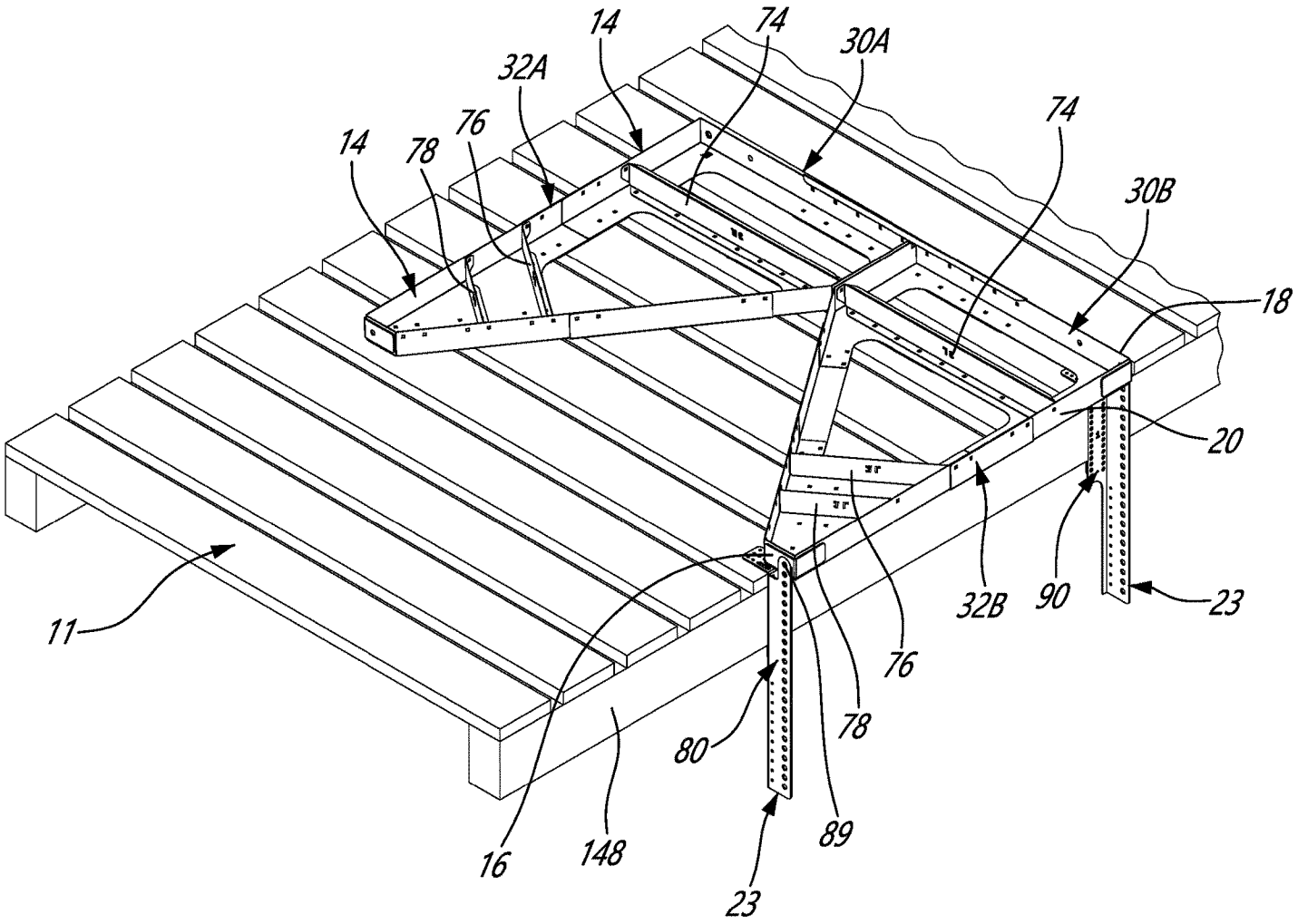
FIGS. 5A to 5D are perspective views of the docking guide from FIG. 1, illustrative the steps of its mounting thereof to a dock.

With reference also to FIGS. 5A, the rigid platform 14 is assembled as follows (in any order):

- the two generally rectangular frame elements 30A and 30B are symmetrically joined via their respective longitudinal end 44 and then secured to one another using a first pair of angle brackets 66 and fasteners (not shown), which respectively attach their front and back portions 34 and 36 together; and
- a triangular frame element 32A, 32B is attached to a respective rectangular frame element 30A, 30B, using i) a second pair of angle brackets 68 to interconnect the respective first connecting parts 46 and 56 thereof, and ii) a third pair of angle brackets 70 to interconnect the respective second connecting parts 48 and 60 thereof.

It results from the above-described assembly that the rigid platform 14 has an opening 12, for receiving the front or bow of the boat 13 therein, wherein the opening 12 is located between the first and second lateral sides 20 and 22 and has a width that decreases from the front side 16 towards the back side 18.

Fasteners (not shown) are used to attach the pieces of the rigid platform 14 together, which includes fastener-receiving holes 72 therein for that purpose. More specifically, a series of holes 72 are provided, which allow various relative distancing between the frame elements 30A and 30B, allowing to adapt for different configuration of boats.

Figure 7A:
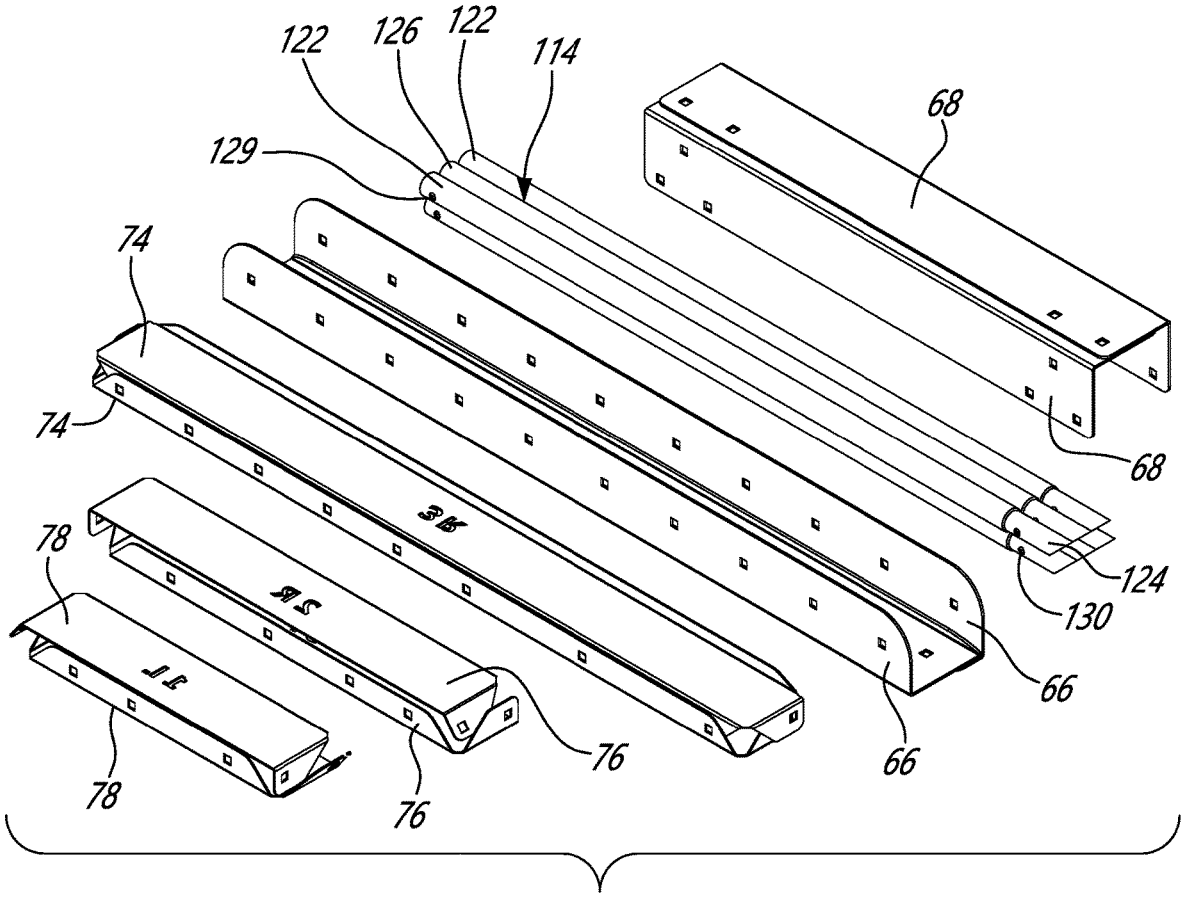
FIGS. 7A and 7B are perspective views illustrating the compact assembly of second parts of the docking guide.

Turning now briefly to FIGS. 5A and 7A, the platform 14 further comprises first braces 74 attached to respective rectangular frame element 30A and 30B, along the front portion 34 thereof, second and third braces 76 each attached to the respective triangular frame elements 32A and 32B between sides 58 and 62 thereof.

According to other illustrative embodiments (not shown), the number and/or location of braces are different than illustrated. According to still another illustrative embodiment, such braces are omitted.

As will now become more apparent from the above, the truncated corners 54 defines the front 16 of the platform 14, the back portions 36 of both rectangular frame elements 30A and 30B defines the back 18 thereof, and lateral side portions 38 of either frame elements 30A, 30B together with the longer straight side 58 of respective triangular member 32A, 32B and angle bracket 68 form the first and second lateral sides 20 and 22 thereof.

Figure 6B:
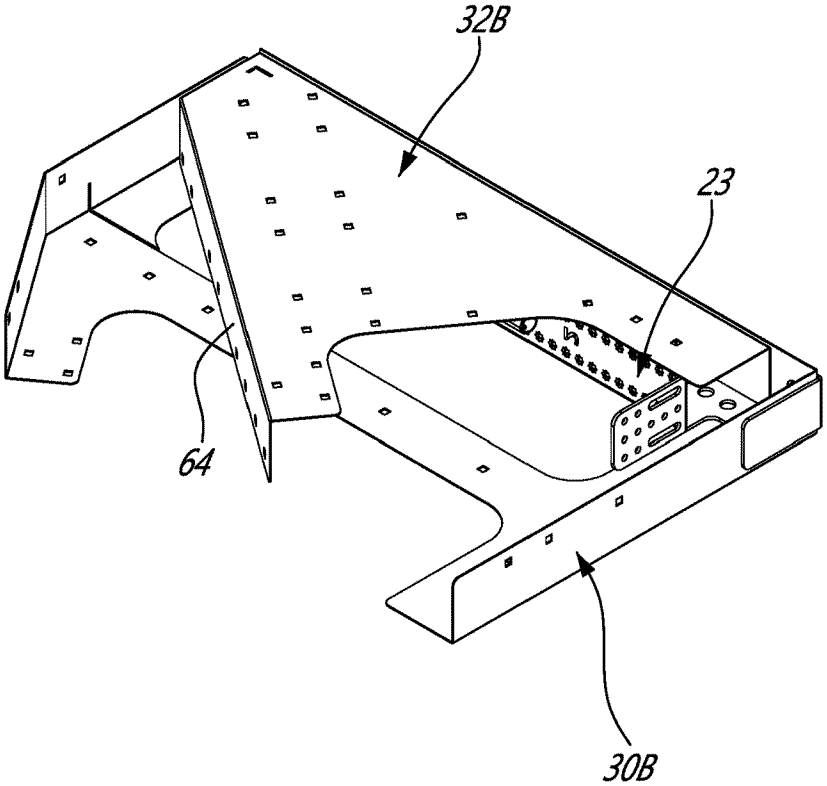
FIGS. 6A and 6B are perspective views illustrating the compact assembly of first parts of the docking guide, for example for shipping purposes.
Figure 6A:
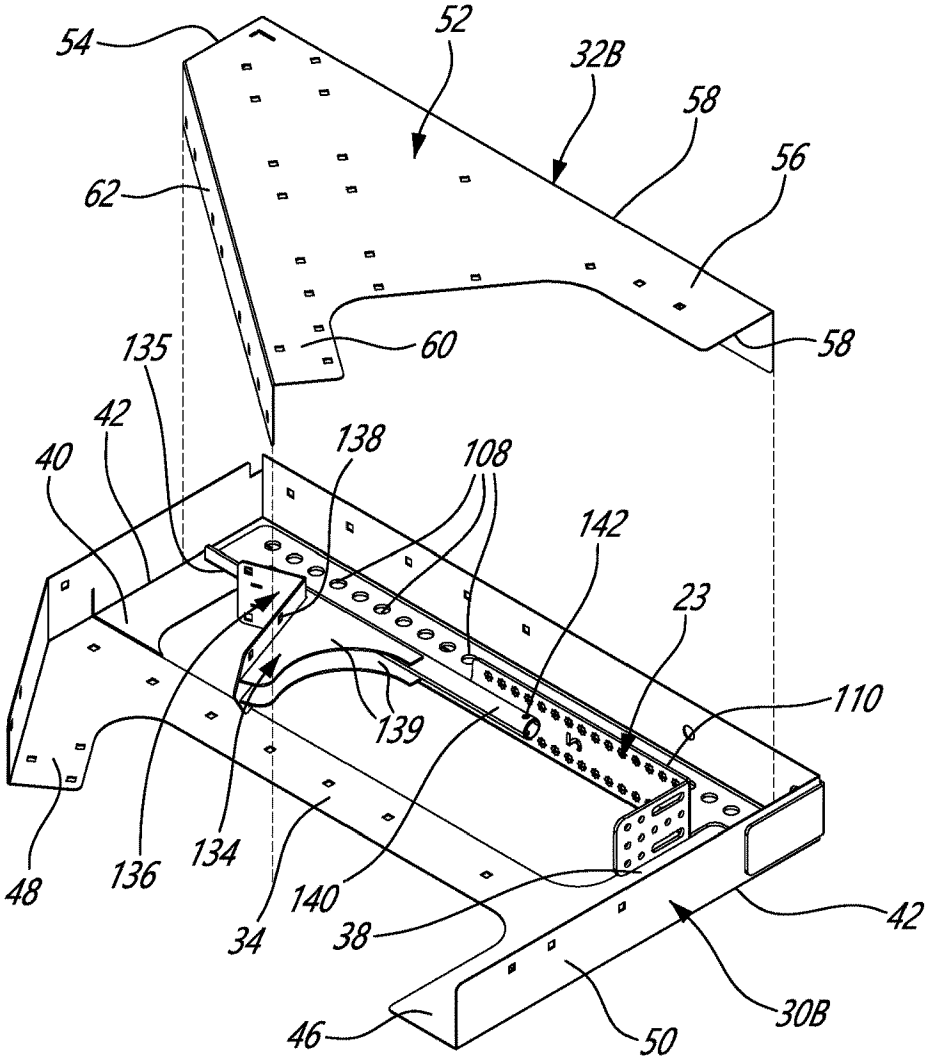

With references more specifically to FIGS. 1, 5A and 6A, the dock mounting brackets 23 includes a first elongated planar portion 80, having a first lateral side 81, extending from first and second longitudinal ends 82 and 84, and a second lateral side 86, which is longer than the first lateral side 81, and which extends from first and third ends 82 and 88, defining an extension 89 beyond the second longitudinal end 84. As will be described hereinbelow in more detail, the second lateral side 86 defines a platform-mounting portion, and the first lateral-side defines an optional bracket-attaching portion.

The mounting brackets 23 further includes a dock-mounting portion 90 comprising a generally P-shaped planar portion 92, extending perpendicularly from the first elongated planar portion 80 on the side of the first lateral side 81 thereof, and being defined by i) a generally rectangular portion 94 extending from the second end 84 to about a third of the length of the first lateral side 81, and ii) a narrow reinforcement portion 96 extending from the rectangular portion 94 to the first longitudinal end 82.

The dock mounting portion 90 further comprises a jaw 98 defined by a) a first plate 100, formed by a bent of the rectangular portion 94 perpendicularly thereof in the direction away from the first elongated planar portion 80, and b) an L-shaped plate 102, that is removably mounted to the rectangular portion 94 so that a horizontal portion 104 of the L-shaped plate 102 is parallel to the first plate 100.

The L-shaped plate 102 is attachable to the rectangular portion 94 via fasteners (not shown) at different positions thereon so that the opening of the jaw 98 can be adapted to different thickness of dock 11. For that purpose, both the L-shaped plate 102 and portion 94 are provided with fastener-receiving holes 104 and 106.

The second lateral side 86 of the planar portion 80 is provided with a series of fastener-receiving holes 108 and defines a platform-mounting portion for attaching the platform 14 thereon.

Finally, the portion of the first lateral side 81 that is along the narrow reinforcement portion 96 is also provided with a series of aligned holes 110, which are provided to receive optional reinforcement cable 112 (see FIG. 4) as will be described hereinbelow in more detail.

As will be described hereinbelow in more detail, the mounting brackets 23 are configured to allow mounting the platform 14 to docks of different configurations. However, the brackets 23 are not limited to such configurations. For example, a dock-mounting bracket according to another illustrative embodiment (not shown), is configured for a specific configuration of dock.

Figure 5B:
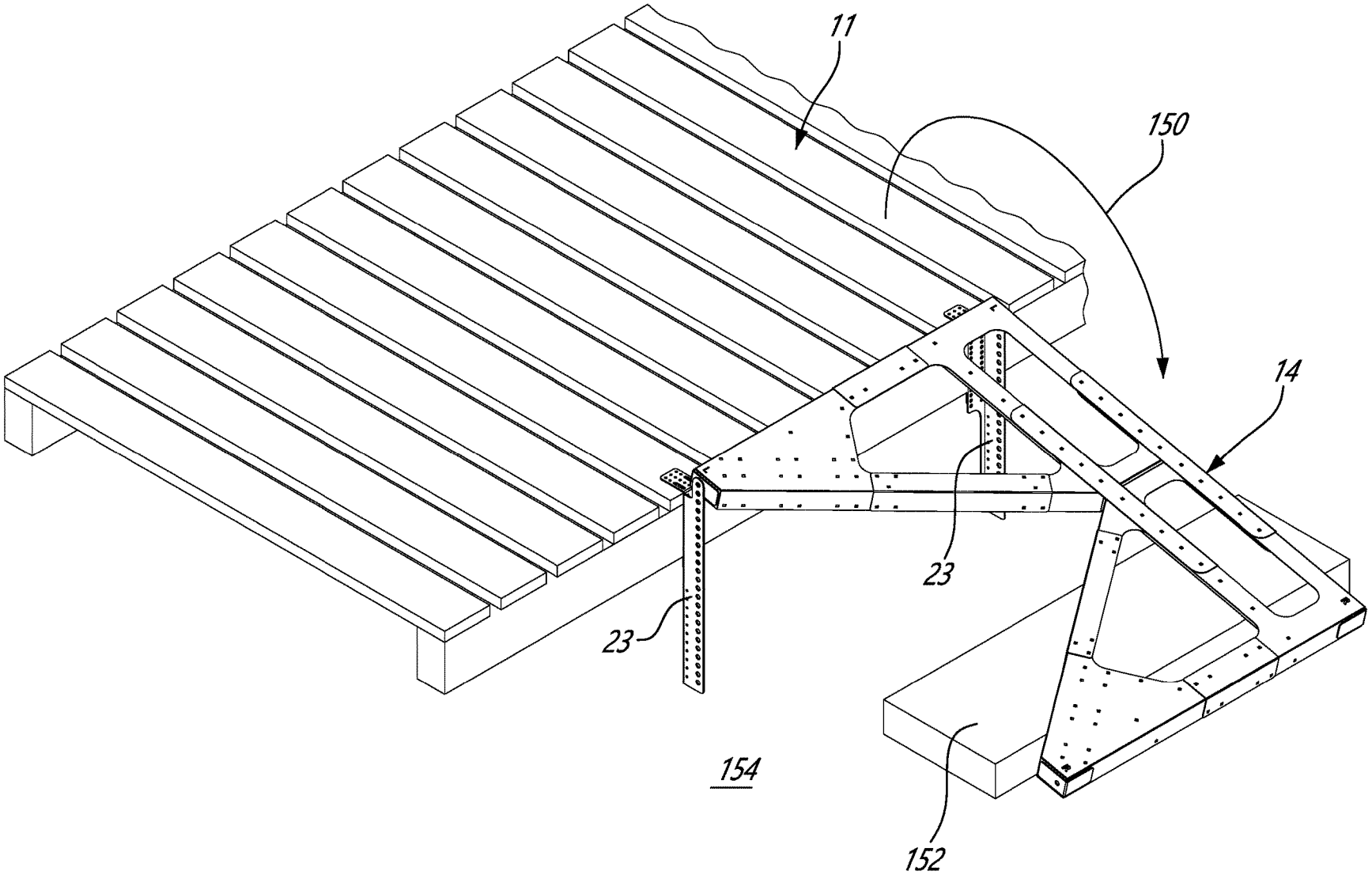
Figure 5C:
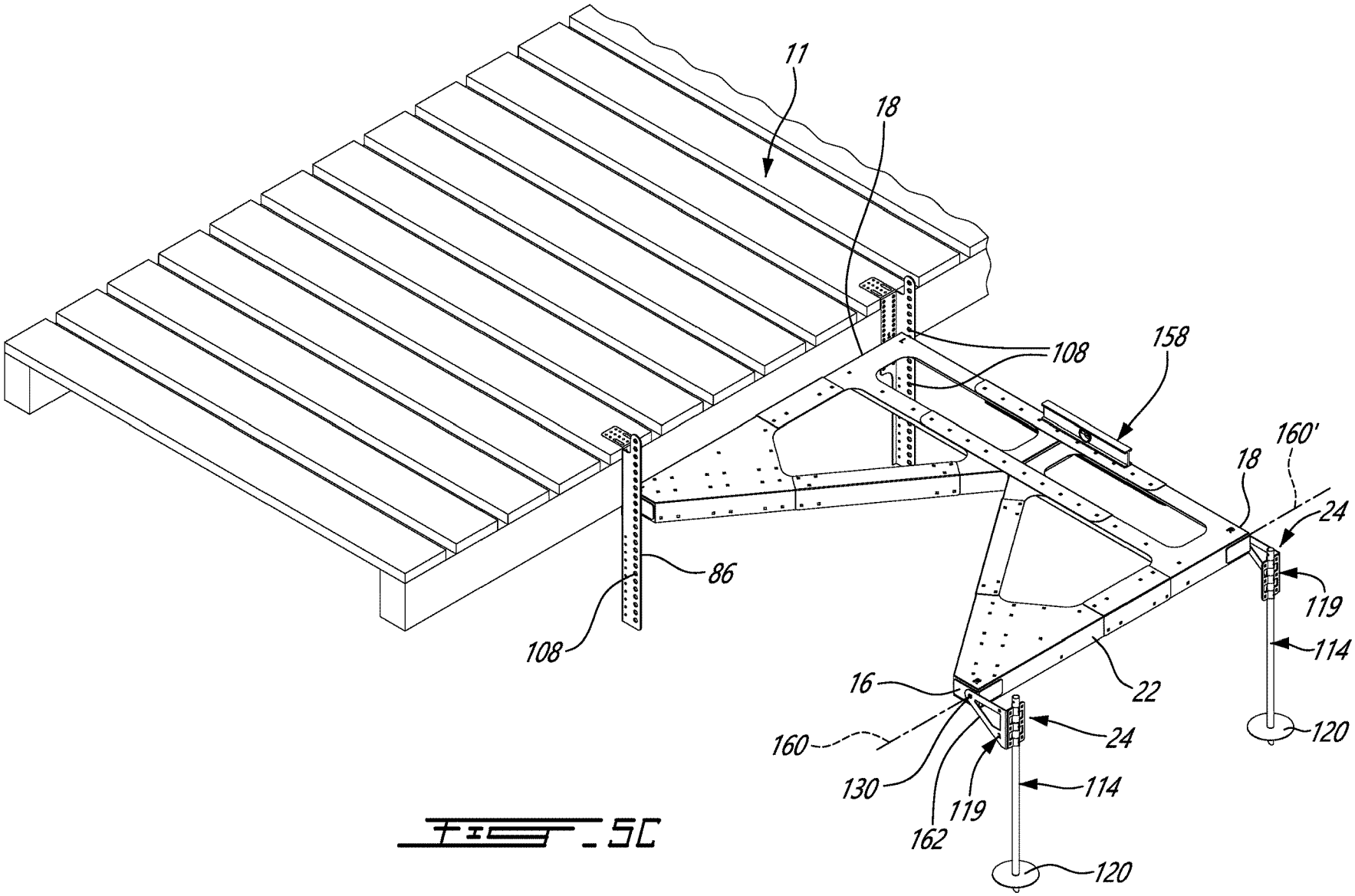

With reference now to FIGS. 1, 3 and 5C, each of the anchoring elements 24 comprises a pole 114 that has proximate and distal longitudinal ends 116 and 118, and that is secured to the platform 14 on the second lateral side 22 thereof via a pole mounting bracket 119, and a seat plate 120, secured to the pole 114 near the distal end 118 thereof.

As can be seen in FIG. 7A, each pole 114 is assembled from a plurality of tubular sections 122 to allow compact storing and shipping thereof, each having cooperating male and female ends 124 and 126, with conventional cooperating button connectors 129 and 130.

According to another embodiment (not shown), another locking mechanism than the button connectors 129-130 is provided or such mechanism is omitted. Also, the number and length of the sections 122 may be different than illustrated. According to still another embodiment (not shown), the poles 114 are made in one section.

The distal end 118 of each pole 114 is spiked to improve its penetration in the underwater ground. According to another illustrative embodiment, the end of each pole 114 is configured differently than illustrated.

The seat plate 120 are provided with a center hole 124 (see FIG. 8A) to receive the pole 114 therethrough. The pole 114 is provided with a hole 126 near its distal end 118 to receive a lock-pin, which allows preventing the plate 120 from detaching from the pole 114.

The use of seat plates 120 has been found to improve the bearing of the pole 114 in the underwater ground, and therefore of the platform 14.

Figure 8B:
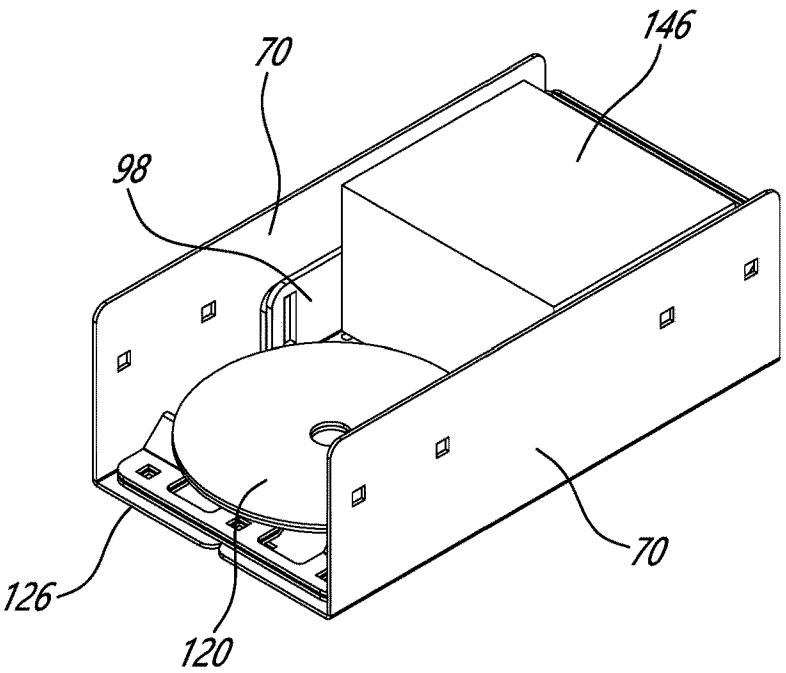
FIGS. 8A and 8B are perspective views illustrating the compact assembly of third parts of the docking guide.
Figure 8A:
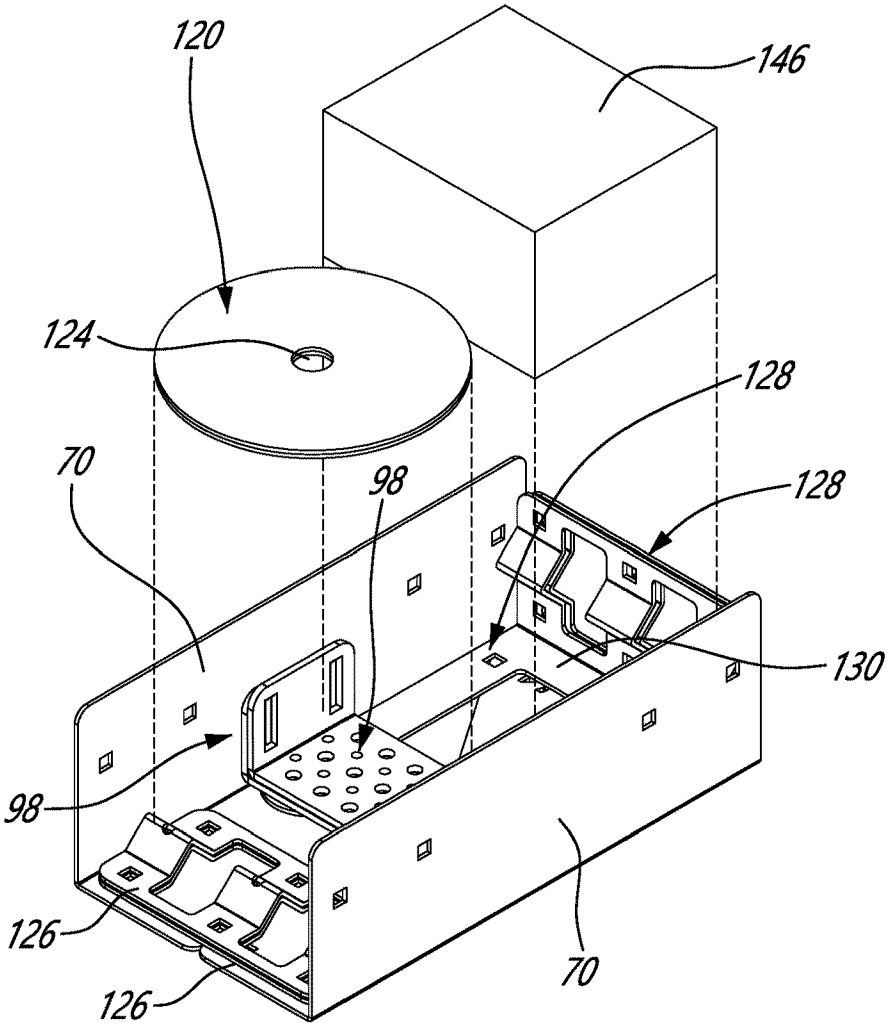

With reference to FIGS. 1, 5C and 8A, each pole mounting bracket 119 includes a pair of channeled plates 126-128, which yield a channel to receive and maintained therebetween a respective pole 114 when the plates 126-128 are assembled face to face using fasteners (not shown). The plate 128 further includes a triangular portion 130 which extends perpendicularly from the main portion and that allows mounting the bracket 119 to the platform 14. Both brackets 119 are attached to the platform 14 near the second lateral side 22, one at the front side 16, the other at the back 18.

According to another embodiment, the pole mounting brackets 119 are configured so that there is no gap between the pole 114 and the platform 14. The pole mounting bracket may also take another form allowing to secure the pole to 114 to the platform 14.

The shock-absorbing deflectors 26 and 28 will be described in more detail. Since both the first and second shock-absorbing deflectors 26 and 28 are identical, only the deflector 26 will be described herein in more detail with reference more specifically to FIGS. 1, 3 and 6A.

The shock-absorbing deflector 26 includes a balloon wheel 132 mounted to the platform 14 via a titled mount 134. The titled mount 134 includes an L-shaped mounting portion 136, including fastener-receiving holes 138, for securing the titled mount 134 to the platform via fasteners (not shown), two side plates 139 that are integral to the mounting portion 136 so as to extend therefrom in a parallel relationship and a wheel-receiving shaft 140, secured to both side plates 139 therebetween by welding or the like. The tilted mount 134 is configured and mounted to the platform 14 so that the shaft 140 extends both upwardly and so as to define about a 70 degrees angle therewith.

A washer (not shown) is mounted to the shaft 140 to act as a mechanical stop under the wheel 132 and a lock-pin or the like (not shown) is secured to the shaft 140 on top of the wheel 132 to lock its position on the shaft 140. A transversal hole 142 is provided on the shaft 140 to receive such locking mechanism.

Since balloon wheels are believed to be well known in the art, they will not be described herein in more detail for concision purposes.

As will be described hereinbelow in more detail, the balloon wheels 132 act mainly as deflectors, but also as shock absorbers, to force a boat 13 moving therebetween in a parallel relationship with the dock 11. The wheels 132 are tilted so as to better conform to the shape of a boat's hull 144. More specifically, the wheels 132 are titled to contact the hull 144 substantially perpendicularly thereto, thereby minimizing the impact therebetween.

According to another embodiment (not shown), the balloon wheels 132 are rotatably mounted to the platform 14 using another assembly than the tilted mount 134, and/or are titled differently relative to the platform 14.

According to still another embodiment (not shown), other deflectors than balloon wheels 132 are used, such as, without restrictions, regular wheels, endless tracks and guide rails. Such deflectors can be mounted or not to shock absorbers, suck spring, cushion material, etc.

The platform 14 parts are made of metal and more specifically of steel with, for example, a hot dipped galvanized and zinc platted finish so as to improve its longevity in water.

According to another embodiment, the platform 14 is made of another rigid material such as aluminum, a polymeric material, fiberglass, etc.

As described hereinabove with references to FIGS. 6A-8B, the rigid platform 14 according to the first illustrative embodiment is assembled from a plurality of pieces so as to allow shipping and storing thereof in relatively compact boxes.

Figure 7B:
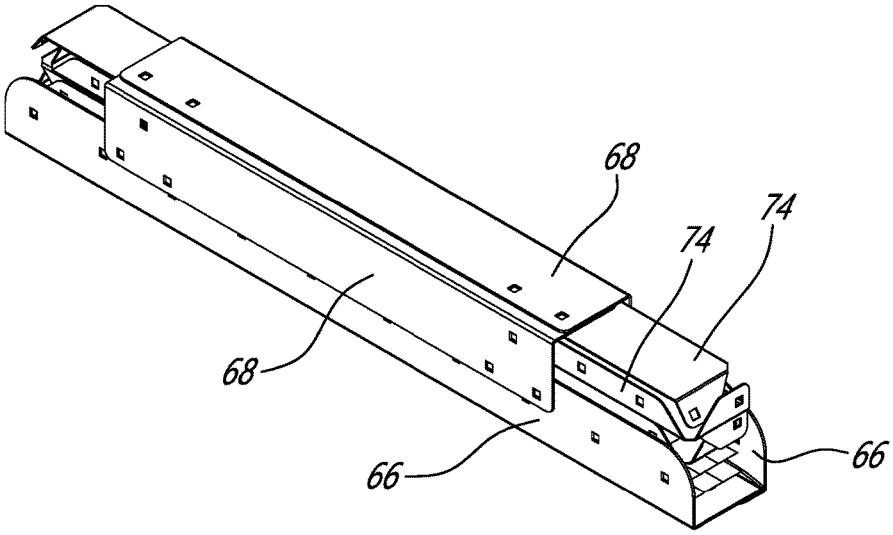

FIGS. 6B, 7B and 8B show exemplary stacking arrangement of parts of the docking guide 10, each that can be compactly boxed, wherein a further stacking arrangement similar to FIG. 6B can be formed with the same but laterally symmetrical parts of the docking guide 10, and wherein both balloon wheels 132 can be stored and shipped separately.

The above-described fasteners, washers, any other hardware and instructions can be further put in a box 146 that conveniently fit in the arrangement shown in FIG. 8B.

More specifically, FIGS. 6A-6B show that the triangular frame element 32A, 32B can be nested in the corresponding rectangular frame element 30A, 30B, in a first compact arrangement, with both a mounting bracket 23 and a titled mount 134 therebetween.

FIGS. 7A-7B show that the angle bracket 66 and 68, the braces 74-78 and the tubular sections 122 of the pole 114 can all be nested in a second compact arrangement.

FIGS. 8A-8B show the compact arrangement of the other parts of the docking guide 10.

The measures of the compact arrangements shown in FIGS. 6B, 7B and 8B are respectively as follows:

1055 mm×690 mm×105 mm;

1100 mm×150 mm×150 mm; and 405 mm×215 mm×120 mm.

Other characteristics and features of the docking guide 10 will become more apparent upon reading the following description of the installation thereof, with reference to FIGS. 5A-5D.

Turning now to FIG. 5A, the platform 14 is first assembled as described hereinabove.

The width (W) of the platform 14, which yields the distance between both deflectors 26 and 28, is set by the user depending on the configuration and size of the boat 13 (see arrow 147, and version of platform 14 in dashed lines on FIG. 2). According to the first illustrative embodiment, the range of possible width between both deflectors 26 and 28 is between about 1100 mm and 2000 mm. Such a range allows the docking guide 10 to be used with boats ranging from about 6 feet (about 182 cm) to about 8 feet (about 243 cm) in width.

For example, a chart (not shown) can be provided to the user which can be based, for example, on the width of the hull 144, as seen from above, taken from a distance of about 100 cm (between about 36" to 42") from the tip of the bow.

Once the platform 14 is assembled in the configuration functionally adequate to the boat 13, the dock mounting brackets 23 are pivotably mounted thereto at its first lateral side 20 in a registered manner, one to the front side 16 and the other to the back side 18 using fasteners, pivot pins or the likes (not shown). For that purpose, the corresponding portions of the platform 14 are provided with holes (not shown). More specifically, the platform 14 is mounted to the extension part 89 of the brackets 23, which are provided to extend above the dock 11 when the dock-mounting portion 90 is levelled with the side 148 of the dock 11.

A person skilled in the art will now appreciate that the configuration of the brackets 23 allows:

i) removably mounting the bracket 23 to the platform 14 while the platform 14 is positioned on the dock 11 upside down; and ii) while the platform 14 is mounted to both brackets 23 and therefore that the distance therebetween is fixed, securing to the side 148 of the dock 11 both brackets 23 via their dock-mounting portion 90, using fasteners (not shown), yielding the correct distance therebetween to secure the platform 14.

As can be seen in FIG. 5B, the platform 14 can then be pivoted towards the water side of the dock 11 (see arrow 150). A flotation element 152 can be used to temporarily prevent the platform from sinking into the water 154. The flotation element can be in the form, for example, of a paddle board, an inner tube, a canoe, etc. A person can also be present in the water to temporarily support the platform 14 or the platform 14 can simply be dropped vertically.

With reference to FIG. 5C, the two poles 114, with the seat plates 120 positioned thereon, are then attached to the platform 14 as described hereinabove. It is to be noted that the pole mounting bracket 119 can be secured to the platform 14 before that step, such as during the assembly of the platform 14. Generally stated, the poles 114 aim at generally levelling and stabilizing the platform 14. It is to be noted that, at this point during installation, the two pairs of channeled plates 126-128 are not tightly pressed together so that the poles 114 are still free to slide therein.

Still with reference to FIG. 5C, the platform 14 is detached from the mounting brackets 23 at its first lateral side 18 and reattached to the second lateral side 86 of the brackets 23 using the appropriate holes 108 therein so that the platform 14 is at the appropriate functional level relative to the dock 11 considering the configuration and size of the boat 13.

It has been found that a distance of about 24" (about 61 cm) between the platform 14 and the boat outline molding 156 (see on FIG. 3) is functional. Of course, such a distance can be adapted to the configuration and size of the boat 13 and considers the overall configuration of the docking guide 10. The docking guide 10 allows variations to about 30 inches (about 76 cm) in the distance between the waterline 168 and the dock 11.

The platform 14 is then levelled by independently fixing the position of each pole 114 relative to the corresponding pole mounting bracket 119. This is achieved by firmly fastening both channeled plates 126-128 together. A conventional level 158 can be positioned on the platform 14 to assess the horizontality of the platform 14. It is to be noted that more or less tubular sections 122 than illustrated can be used in addition or alternatively to moving the poles along the brackets 119.

According to another illustrative embodiment (not shown), telescopic poles are used instead of pole sections 122.

It is to be noted that the proximate side of the brackets 119 are mounted to the platform 14 for independent pivot movement about axes 160 and 160' via pivot pins 162 (only one shown). This allows a range of movements of the platform 14 during contact of a boat 13 to minimize fatigue on the platform 14 in view of increasing its duration. This has also been found to improve the efficiency of the docking guide 10 in forcing a parallel relationship between the boat 13 and the dock 11. The mounting of the platform 14 to both brackets 23 is also swivel.

Figure 5D:
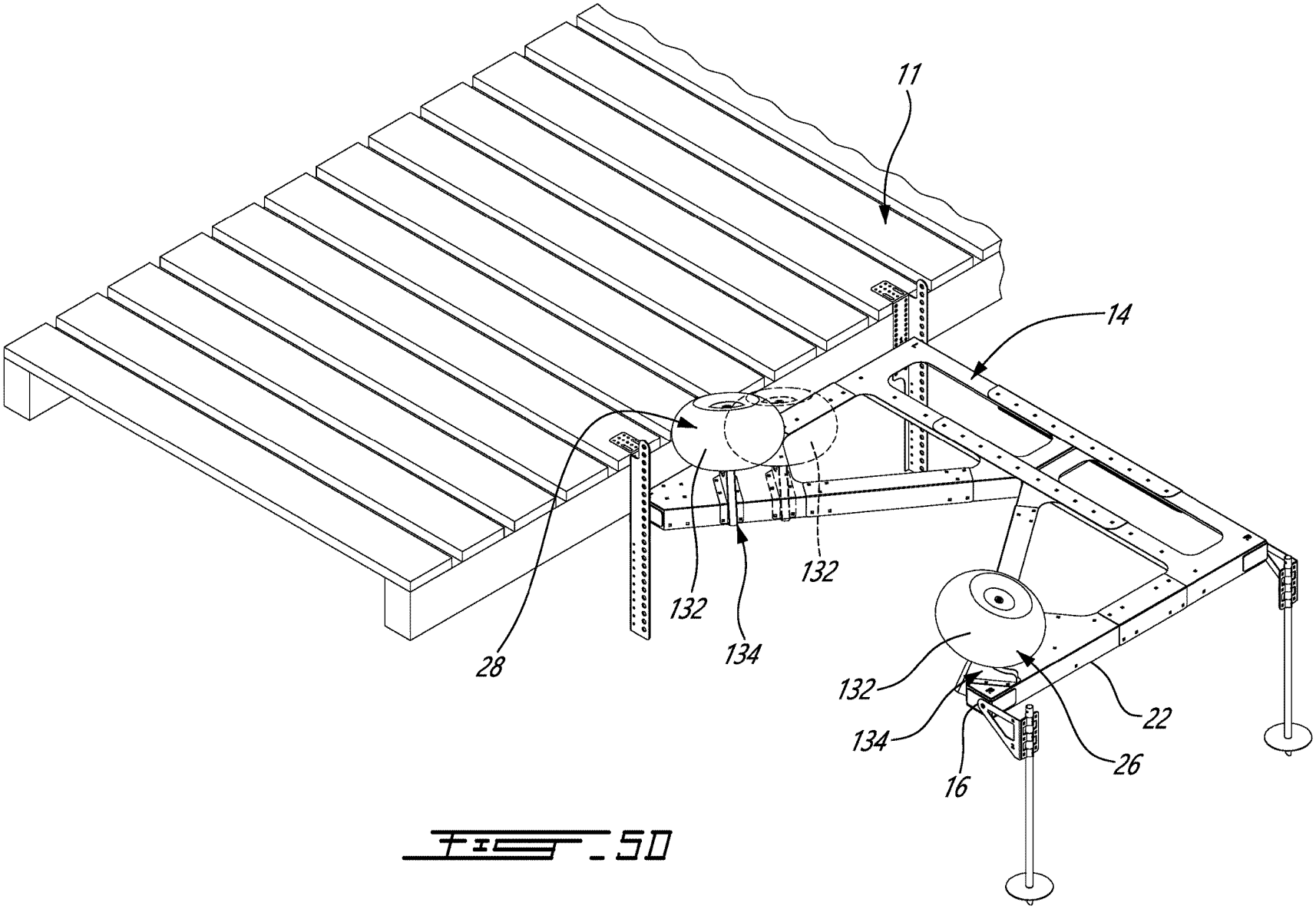

With reference to FIG. 5D, the balloon wheels 132 are finally mounted to the platform 14 using the tilted mount 134. While the position of the deflector 26 is fixed, there is a plurality of mounting positions for the deflector 28 (see a second possible position shown in dashed lines in FIG. 5D), yielding more adaptability of the docking guides 10 for different boat sizes and configurations.

For example, according to the configuration of the deflector 28 shown in solid lines in FIG. 5D, the axis (not shown) intersecting the rotational axes of both wheels 132 defines an angle of 82.5 degrees with the normal to the dock 11, while the same axis defines a 75 degrees angle with the normal to the dock 11 for the configuration that includes the wheel 132 shown in dashed lines (second configuration).

Of course, other mounting positions can be provided on the platform 14 for the deflector 28.

According to another illustrative embodiment, a different number of mounting positions than illustrated can be provided for the deflectors 26 and or 28.

With reference to FIGS. 2 to 3, the operation of the docking guide 10 will now be described in more detail.

When the boat 13 moves towards the dock 11 for docking (see arrow 164, the captain (not shown) conventionally tries to align its boat 13 between both balloon wheels 132, and more generally parallel to the dock 11. However, in cases where the water is choppy because there is a strong wind, or because the dock 11 is crowdy of other boats or for any other reason that causes the boat 13 to approach the dock 11 at an angle, the captain of the boat simply aims between both balloon wheels 132.

As soon as the boat 13 comes into contact with the balloon wheels 132, the boat 13 is automatically brought in parallel relationship with the dock 11 under the forward force of the boat 13 and a lever effect caused by the deflector 28 being shifted (see arrow 165) towards the back of the platform 14 relative to the other deflector 26 (see arrow 166).

Also, the balloon wheel 132 being resilient, they absorb most of the impact of the boat 13 with the platform 14.

Figure 4:
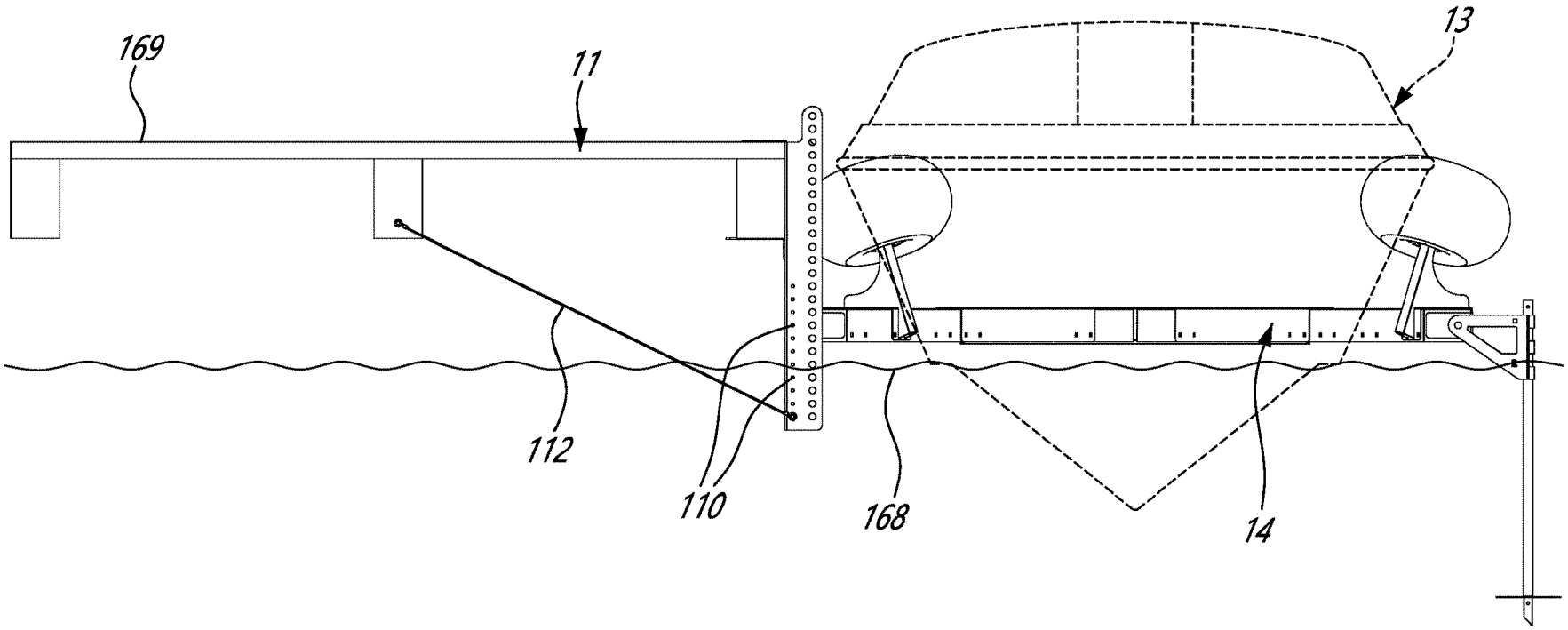
FIG. 4 is a back elevation similar to FIG. 3, illustrating an alternative mounting of the guide to the dock.

As can be seen in FIG. 4, it results that the boat 13 is generally centered with the platform 14 and parallel to the dock 11.

As a further advantage of the docking guide 10, the front of the boat 13 does not need to be moor and the captain or a passenger (not shown) may simply get on the dock to moor the stern of the boat 13.

As can be better seen in FIG. 3, the balloon wheels 132 are mounted to the platform 14 so as to present an angle that generally conforms to the shape of the boat hull 144. More specifically, the wheels 132 are both tilted upwardly towards the opening 12 of the platform 14 and towards the front 16 thereof. These angles of the wheels 132 have been found to impose a downward force on the boat hull 144, when the boat 13 enters the platform 14 and reducing the impact.

According to another embodiment (not shown), the wheels 132 are mounted to the platform 14 at different angles than illustrated.

FIG. 4 illustrates a case wherein the waterline 168 is low relative to the dock surface 169. In such a case, for example, when the platform 14 has to be secured to the lower half of the brackets 23, both brackets 23 can be further secured to the dock 11 using reinforcement cables 112 that are attached to the brackets 23 via one or more of their series of holes 110. This brings further rigidity to the platform 14.

Figure 9:
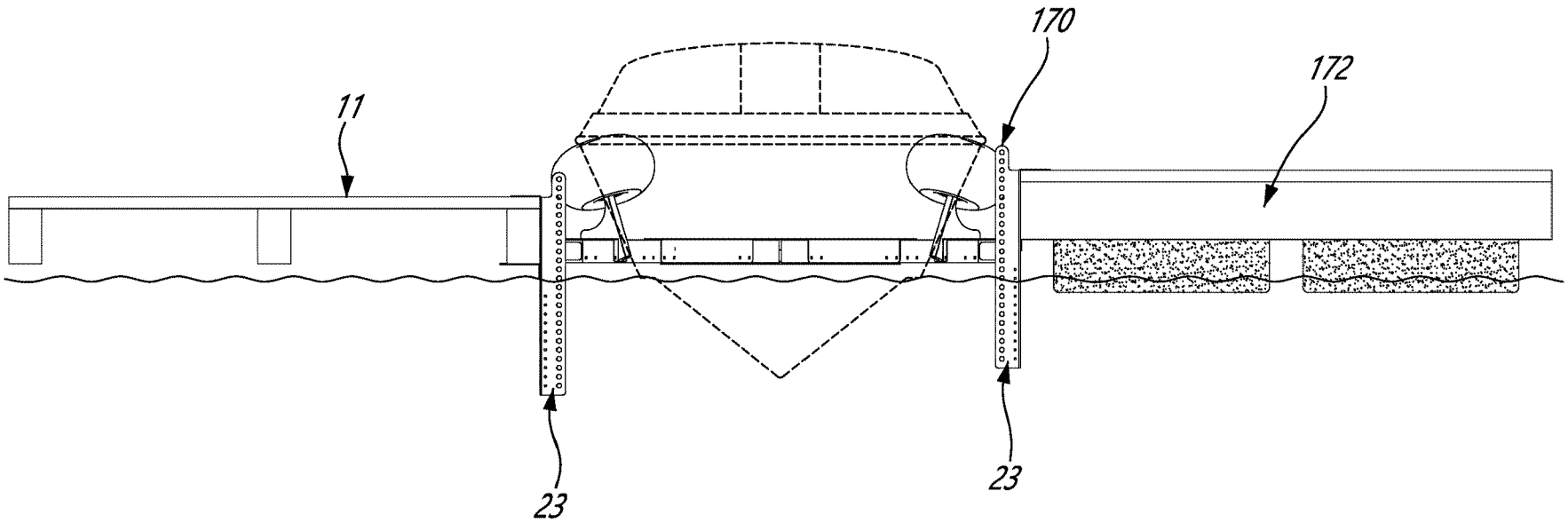
FIG. 9 is a back elevation of a docking guide according to a second illustrative embodiment.

Turning now to FIG. 9, a docking guide 170 for boat according to a second illustrative embodiment will now be described, Since the docking guide 170 is very similar to the docking guide 10, only the differences therebetween will be described herein for concision purposes.

According to this illustrative embodiment, a floating dock 172 replaces the poles 114 as the anchoring element on the lateral side 22 of the platform 14 opposite the dock 11.

The platform 14 is secured to the floating dock 172 using a pair of mounting brackets 23 (only one shown) similarly to those used for its mounting to the dock 11 as described hereinabove.

It is to be noted that many modifications could be made to the docking guides 10 and 170 described hereinabove and illustrated in the appended drawings. For example:

- the platform 14 is not limited to being mountable to a fixed dock 11 and cab be secured to a floating-type dock (not shown) on its first lateral side 20;
- the opening 12 of the platform 14 is not limited to be generally triangular in shape and can also be round or rectangular;
- parts of the docking guide can be assembled using other fastening means than fasteners and can also be made of parts having different configurations and sizes.

Although a docking guide has been described hereinabove by way of illustrated embodiments thereof, it can be modified. It is therefore to be understood that numerous modifications may be made to the illustrative embodiments and that the scope of the claims should not be limited by the illustrative embodiments but should be given the broadest interpretation consistent with the description as a whole.

What is claimed is:

1. A docking guide for a boat comprising:

a platform having front and back sides, a first lateral side for mounting to a dock, and a second lateral side opposite the first lateral side; the platform having an opening, for receiving a front of the boat therein, located between the first and second lateral sides;

at least one anchoring element secured to the platform on the second lateral side;

a first deflector mounted to the platform thereabove so as to be partially in the opening near an intersection of the front and second lateral sides; and a second deflector mounted to the platform thereabove so as to be partially in the opening near an intersection of the front and first lateral sides; the second deflector being shifted towards the back side relatively to the first deflector;

whereby, the boat moving towards and then within the opening of the platform is forced in a parallel relationship with the dock by its contact with the first and second deflectors.

2. The docking guide as recited in claim 1, wherein at least one of the first and second deflectors is a shock-absorbing deflector.

3. The docking guide as recited in claim 2, wherein the shock absorbing deflector includes a balloon wheel.

4. The docking guide as recited in claim 3, wherein the balloon wheel is mounted to the platform via a tilted mount that includes a mounting portion for securing the tilted mount to the platform and a shaft that is secured to the mounting portion for rotatably receiving the balloon wheel; the shaft being tilted both upwardly towards the opening of the platform and towards the front thereof.

5. The docking guide as recited in claim 2, wherein both first and second deflectors are shock-absorbing deflectors that are mounted to the platform at angles that together substantially conform to a bow of the boat.

6. The docking guide as recited in claim 1, wherein the platform includes two symmetrical lateral sides joined together, each including a substantially rectangular frame element joined to a substantially triangular frame element, yielding the opening being triangular.

7. The docking guide as recited in claim 6, wherein both substantially rectangular frame elements are joinable side-by-side at a plurality of lateral distances to one another so as to vary a width of the opening of the platform.

8. The docking guide as recited in claim 6, wherein the platform further comprising at least one first bracket for attaching both substantially rectangular frame elements together side-by-side and second and third brackets for attaching each pair of substantially rectangular and triangular frame elements together.

9. The docking guide as recited in claim 8, further comprising a pair of dock mounting brackets for securing the platform to the dock at the first lateral side.

10. The docking guide as recited in claim 9, wherein each of the dock mounting bracket is nestable in one of the substantially triangular frame members, which is nestable in one of the substantially rectangular frame members, yielding a compact arrangement.

11. The docking guide as recited in claim 10, wherein the compact arrangement measures less than 1100 mm×700 mm×110 mm.

12. The docking guide as recited in claim 6, wherein the platform further comprising reinforcing braces secured to at least one of the substantially rectangular frame elements and substantially triangular frame elements.

13. The docking guide as recited in claim 1, wherein the opening has a width that decreases from the front side towards the back side.

14. The docking guide as recited in claim 1, further comprising a pair of dock mounting brackets for securing the platform to the dock at the first lateral side; the pair of dock mounting brackets being configured to be attached to the dock in a spaced apart parallel relationship so and to receive the platform therebetween.

15. The docking guide as recited in claim 14, wherein each of the dock mounting brackets includes a dock mounting portion on a first side thereof for securing to the dock and a platform mounting portion on a second side thereof opposite the first side for receiving the platform; the dock mounting portion including a jaw for securing to the dock and at least one attachment-receiving hole below the jaw.

16. The docking guide as recited in claim 15, wherein each of the dock mounting brackets includes an extension that longitudinally extends beyond the dock mounting portion on the first side;

whereby, in installation of the docking guide, the platform, while positioned upside down on the dock, is pivotably attachable to both extensions therebetween, before attaching the pair of dock mounting brackets to the dock, thereby, allowing to set the mounting distance between both dock mounting brackets.

17. The docking guide as recited in claim 15, wherein the platform mounting portion includes a planar portion having at least one first fastener-receiving hole therein; the front and back sides of the platform each being provided with a second fastener-receiving hole near the first lateral side thereof for cooperating with both one of the at-least one first fastener receiving hole of the planar portion and a fastener to mount the platform to the pair of dock mounting brackets therebetween.

18. The docking guide as recited in claim 17, wherein the at least one first fastener includes a series of aligned first fasteners, yielding a plurality of mounting position for the platform along the platform mounting portion.

19. The docking guide as recited in claim 14, wherein the platform is swivel mounted to the pair of dock mounting brackets therebetween.

20. The docking guide as recited in claim 1, wherein the at least one anchoring element includes at least one pole.

21. The docking guide as recited in claim 20, wherein the at least one pole includes two poles, each being secured near a respective one of the front and back side of the platform.

22. The docking guide as recited in claim 20, wherein the at least one pole is made from a plurality of pole sections.

23. The docking guide as recited in claim 20, wherein the at least one anchoring element further includes a seat plate secured to the pole near a distal end thereof.

24. The docking guide as recited in claim 1, wherein the at least one anchoring element includes a floating dock.

25. The docking guide as recited in claim 24, further comprising a pair of dock mounting brackets for securing the platform to the floating dock; the pair of dock mounting brackets being configured to be attached to the dock in a spaced apart parallel relationship so and to receive the platform therebetween; each of the dock mounting brackets including a dock mounting portion on a first side thereof for securing to the floating dock and a platform mounting portion on a second side thereof opposite the first side for receiving the platform.

26. The docking guide as recited in claim 1, wherein the at least one anchoring element is swivel mounted to the platform.

27. The docking guide as recited in claim 1, wherein the platform includes a plurality of predetermined optional mounting positions along the opening for mounting the second deflector.

* * * * *